US007959431B2

(12) United States Patent
Quinn

(10) Patent No.: US 7,959,431 B2
(45) Date of Patent: Jun. 14, 2011

(54) RADIANT TUBE WITH RECIRCULATION

(75) Inventor: Dennis E. Quinn, Hinckley, OH (US)

(73) Assignee: Fives North American Combustion, Inc., Cleveland, OH (US)

( * ) Notice: Subject to any disclaimer, the term of this patent is extended or adjusted under 35 U.S.C. 154(b) by 184 days.

(21) Appl. No.: 12/106,454

(22) Filed: Apr. 21, 2008

(65) Prior Publication Data

US 2009/0263753 A1 Oct. 22, 2009

(51) Int. Cl.
*F23M 3/00* (2006.01)
*F23C 3/00* (2006.01)

(52) U.S. Cl. ..... 431/9; 431/115; 431/116; 126/91 A; 126/99 A

(58) Field of Classification Search ..... 431/115, 431/116, 9; 126/91 A, 99 A
See application file for complete search history.

(56) References Cited

U.S. PATENT DOCUMENTS

| | | | | |
|---|---|---|---|---|
| 1,244,864 | A | 10/1917 | Kemp et al. | |
| 2,091,980 | A | 9/1937 | Hamlink | |
| 2,188,133 | A | 1/1940 | Hepburn | |
| 2,882,843 | A * | 4/1959 | Powell | 431/116 |
| 3,990,831 | A | 11/1976 | Syska | |
| 4,445,842 | A | 5/1984 | Syska | |
| 4,601,655 | A | 7/1986 | Riley et al. | |
| 4,629,413 | A | 12/1986 | Michelson et al. | |
| 4,712,734 | A | 12/1987 | Johnson | |
| 4,800,866 | A | 1/1989 | Finke | |
| 4,828,483 | A | 5/1989 | Finke | |
| 5,000,158 | A | 3/1991 | Watson et al. | |
| 5,269,679 | A | 12/1993 | Syska et al. | |
| 5,350,293 | A * | 9/1994 | Khinkis et al. | 431/116 |
| 5,368,472 | A | 11/1994 | Hovis et al. | |
| 5,388,985 | A * | 2/1995 | Musil et al. | 431/116 |
| 5,529,484 | A * | 6/1996 | Moard et al. | 431/242 |
| 5,775,317 | A | 7/1998 | Finke | |
| 6,029,647 | A | 2/2000 | Pisano et al. | |
| 6,190,159 | B1 | 2/2001 | Moore et al. | |
| 6,663,380 | B2 | 12/2003 | Rabovitser et al. | |
| 7,264,466 | B2 | 9/2007 | Miller et al. | |
| 2006/0199127 | A1 | 9/2006 | Butler | |
| 2007/0054227 | A1 * | 3/2007 | Tada et al. | 431/181 |

FOREIGN PATENT DOCUMENTS

JP 05248631 A * 9/1993

OTHER PUBLICATIONS

North American Combustion Handbook, "A Practical Basic Reference on the Art and Science of Industrial Heating with Gaseous and Liquid Fuels", Third Edition, vol. II, North American Mfg., Co., Cleveland, Ohio. 1995, pp. 14-16 and p. 395.

Berg et al., "Nitric Oxide Formation and Reburn in Low-Pressure Methane Flames", Twenty-Seventh Symposium (International) on Combustion/The Combustion Institute, 1998, pp. 1377-1383.

Bilbao et al., "Experimental Study and Modelling of the Burnout Zone in the Natural Gas Reburning Process", Chemical Engineering Science, vol. 50, No. 16, 1995, pp. 2579-2587.

* cited by examiner

*Primary Examiner* — Kenneth B Rinehart
*Assistant Examiner* — Jorge Pereiro
(74) *Attorney, Agent, or Firm* — Jones Day

(57) ABSTRACT

A burner fires into a radiant tube to provide a downstream flow of combustion products within the radiant tube. Staged fuel is injected upstream into the radiant tube. A recirculation conduit inside the radiant tube receives the staged fuel along with combustion products that are inspirated into the recirculation conduit by the staged fuel. The recirculation conduit has an outlet for discharging a mixture of the inspirated combustion products and staged fuel into the downstream flow of combustion products.

20 Claims, 8 Drawing Sheets

RADIANT TUBE WITH RECIRCULATION

TECHNICAL FIELD

This technology relates to a radiant tube for heating a process chamber in a furnace.

BACKGROUND

A radiant tube is a device that is used to heat a process chamber in a furnace. The tube extends across the process chamber. A burner is fired into one end of the tube, or a pair of burners alternately fire into opposite ends of the tube. In each case combustion proceeds downstream along the length of the tube from the firing burner toward the other end of the tube. The process chamber is heated by thermal energy that radiates from the tube as a result of combustion within the tube.

SUMMARY

A method includes the steps of providing a downstream flow of combustion products in a radiant tube, injecting staged fuel into the tube, and recirculating the gaseous contents of the tube. The recirculating step withdraws combustion products from the downstream flow and mixes the staged fuel with the withdrawn combustion products. The mixture is transported upstream relative to the downstream flow along a recirculation flow path that is separate from the downstream flow, and is then discharged into the downstream flow.

In a preferred apparatus for performing the method, a burner fires into the radiant tube in a direction downstream from the burner to provide the downstream flow of combustion products within the tube. An injector injects a stream of staged fuel into the tube in the upstream direction. A recirculation conduit defines the recirculation flow path that is separate from the downstream flow. The conduit has an inlet aligned with the injector to receive the stream of staged fuel, and also to receive combustion products that are inspirated into the conduit by the stream of staged fuel. The conduit further has an outlet for discharging a mixture of the combustion products and staged fuel into the downstream flow at a location between the inlet and the burner.

DETAILED DESCRIPTION

Figure 1:
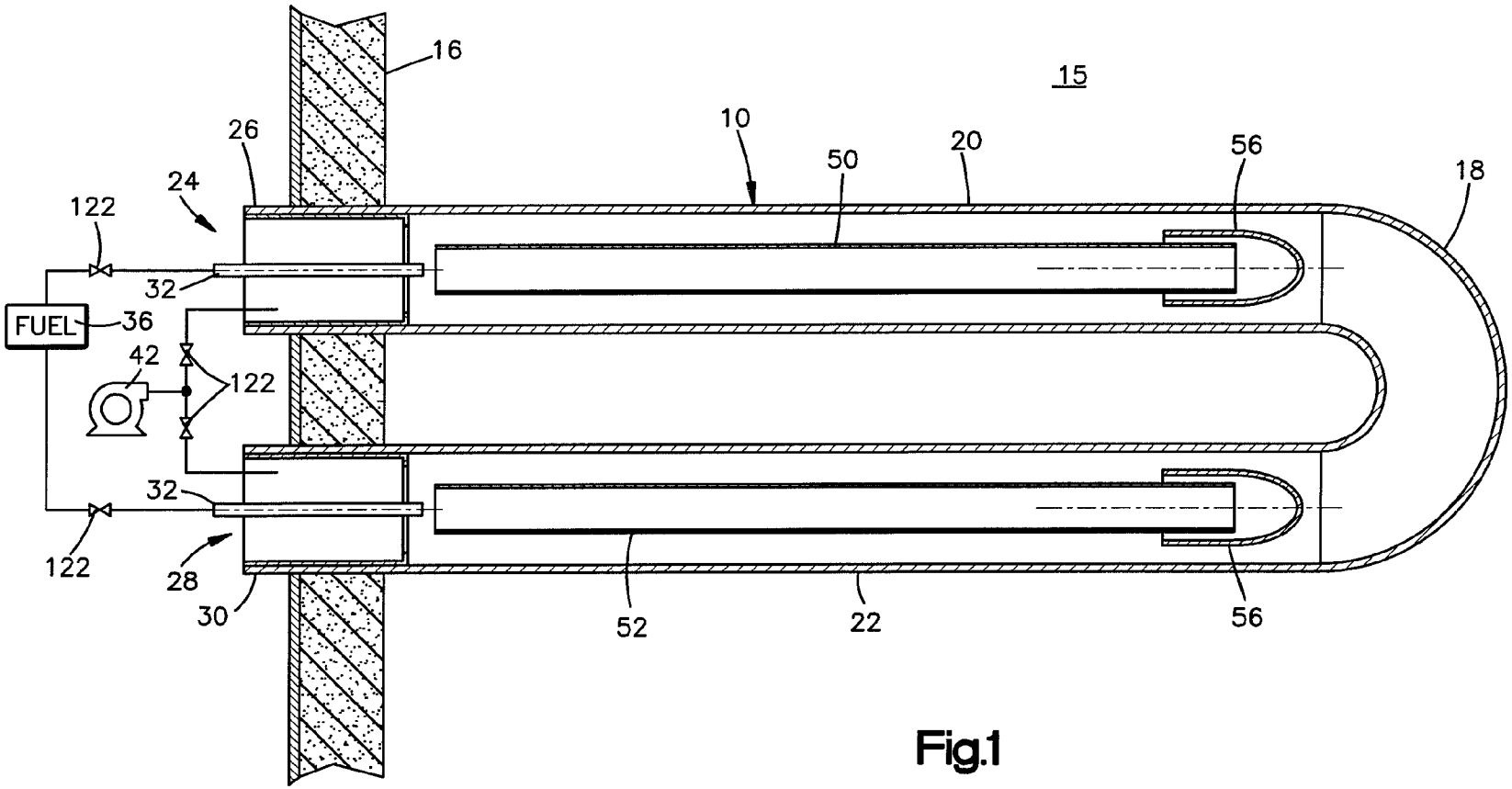
FIG. 1 is a schematic view of a furnace apparatus including a radiant tube equipped with recirculation conduits.

The apparatus shown in the drawings has parts that are examples of the elements recited in the claims. The following description thus includes examples of how a person of ordinary skill in the art can make and use the claimed invention. It is presented here to meet the statutory requirements of written description, enablement, and best mode without imposing limitations that are not recited in the claims.

As shown schematically in FIG. 1, a radiant tube 10 for heating process chamber 15 projects from a furnace wall 16 into the process chamber 15. The illustrated example is a U-shaped tube 10 with a 180° turn 18 between two legs 20 and 22. A first burner 24 is located at one end portion 26 of the tube 10. A second burner 28 is located at the opposite end portion 30 of the tube 10. The burners 24 and 28 can be operated in alternating regenerative cycles in which one burner fires into the tube 10 while the other burner does not.

When a burner 24 or 28 fires into the tube 10, it receives preheated combustion air from a regenerative bed (not shown). The products of combustion that are generated by the firing burner flow within the tube 10 in a direction downstream from the firing burner toward the non-firing burner. The combustion products are then exhausted through the non-firing burner, and are directed into the regenerative bed. This heats the regenerative bed which, in turn, heats the combustion air when the non-firing burner is again fired in the next consecutive regenerative cycle. As the burners 24 and 28 are cycled in this manner, the radiant tube 10 becomes heated by the combustion products that flow alternately through the tube 10 in opposite directions. The process chamber 15 is then heated by thermal energy radiated from the tube 10.

The burners 24 and 28 in the illustrated example are alike. Each has the structure shown in FIG. 2, which includes a fuel injector 32 with an outlet 33 centered on an axis 35. The injector 32 receives a pressurized flow of fuel from a source 36 (FIG. 1), and injects the fuel into the tube 10 in the form of a stream projecting from the outlet 33 along the axis 35. The fuel source 36 is preferably the plant supply of natural gas.

Each burner 24 and 28 further includes an oxidant baffle 40 with a circular opening 41 through which the fuel injector 32 extends along the axis 35. A blower 42 drives a pressurized flow of combustion air from the regenerative bed to the baffle 40. The baffle 40 directs the combustion air through the opening 41 in the form of an annular stream that surrounds the stream of fuel emerging from the outlet 33. Those reactant streams form a combustible mixture as they flow downstream from the burner 24 or 28. An igniter can be actuated to initiate combustion of the mixture in a startup mode, but an igniter is not needed when the gaseous contents of the tube 10 have reached the autoignition temperature of the mixture through previous cycles of burner operation.

In addition to the first and second burners 24 and 28, the radiant tube 10 is further equipped with first and second recirculation conduits 50 and 52. The recirculation conduits 50 and 52 in the illustrated example also are alike. Each has the structure of the conduit 50 shown in FIG. 2, and is mounted within the tube 10 to define an elongated annular gas flow passage 53 radially between the conduit 50 and the tube 10. Each passage 53 preferably extends the entire length, or at least substantially the entire length, of the tube leg 20 or 22 in which the conduit 50 or 52 is mounted.

Figure 2:
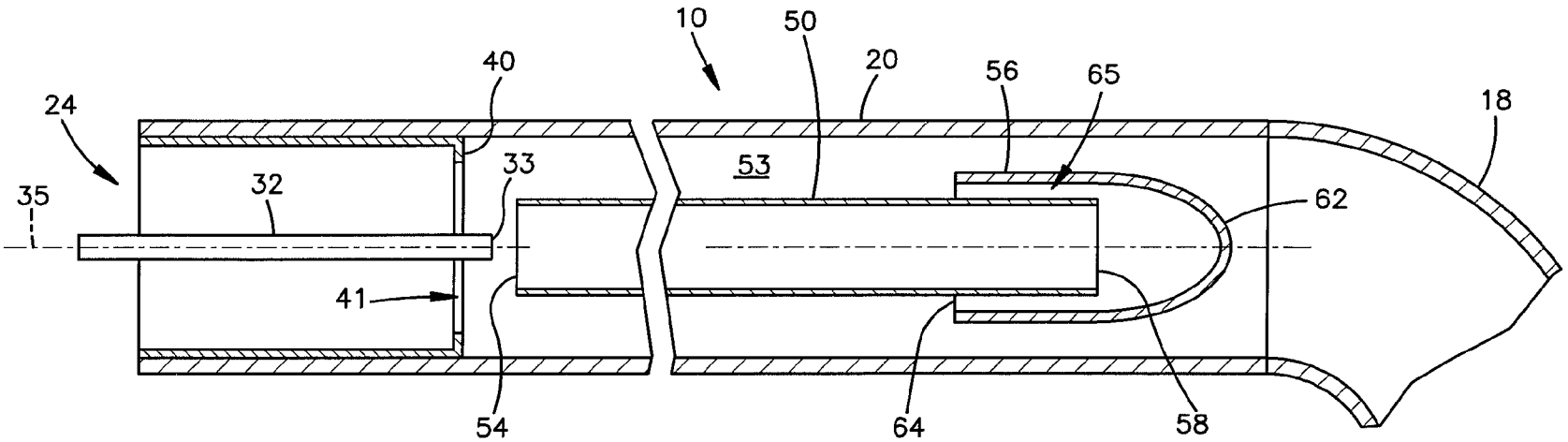
FIG. 2 is an enlarged partial view of parts shown in FIG. 1.

As further shown schematically in FIG. 2, a first open end 54 of the conduit 50 is centered on the axis 35 at a location spaced a short distance downstream from the fuel outlet 33 at the adjacent burner 24. A hood 56 is received over a second open end 58 of the conduit 50. The hood 56 has a closed end 62 and an open end 64, and extends over the conduit 50 to define a short annular gas flow passage 65 axially between the open end 58 of the conduit 50 and the open end 64 of the hood 56.

The recirculation conduits 50 and 52 are configured for operation of the burners 24 and 28 in differing regenerative modes. These include a low temperature mode and a high temperature mode. The low temperature mode is preferred when the temperature within the tube 10 is lower than about 1,400° F. The high temperature mode is preferred when the temperature within the tube 10 is about 1,400° F. or higher.

Figure 3:
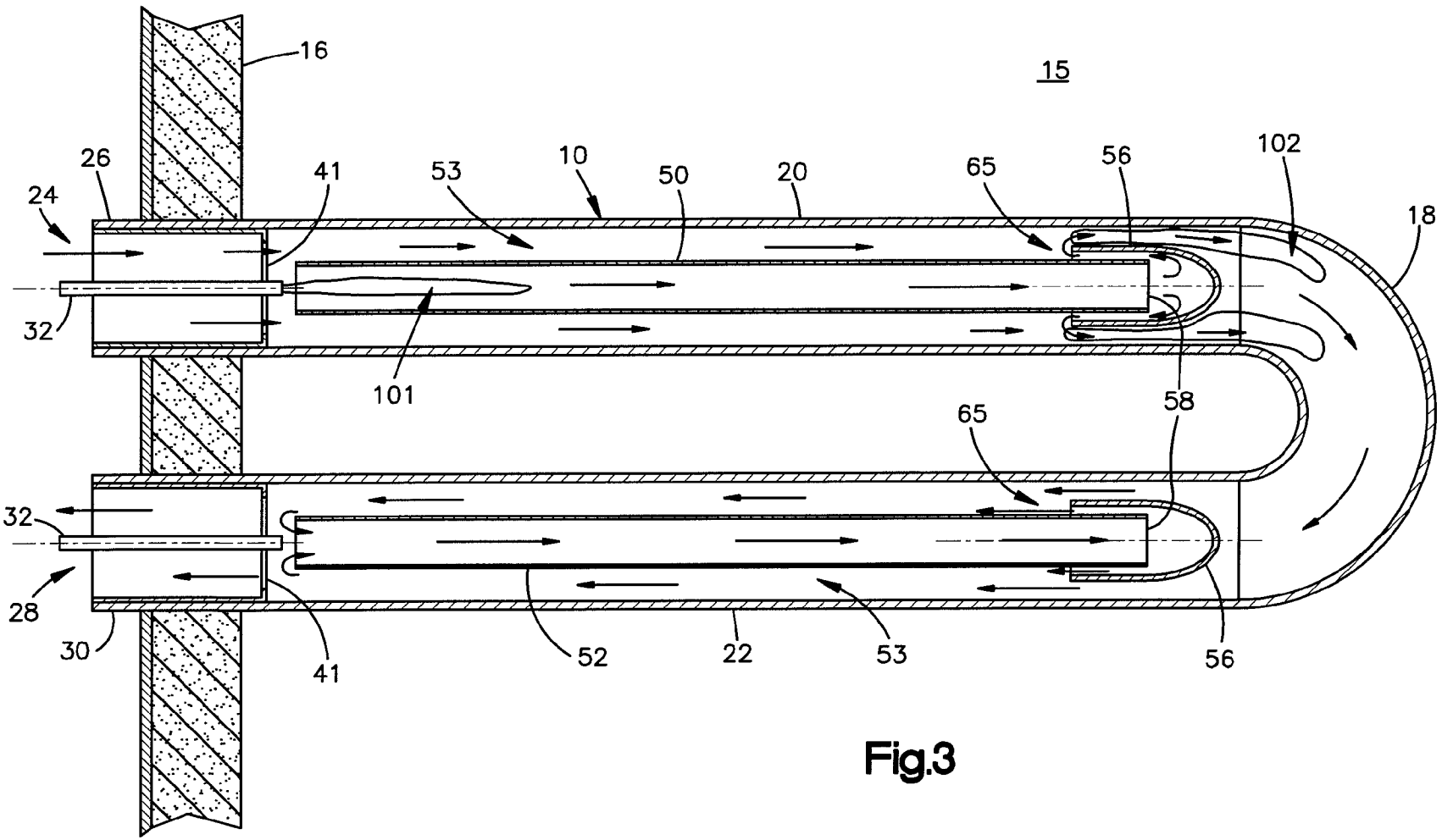
FIG. 3 is a view similar to FIG. 1, schematically illustrating an operating condition of the radiant tube.

When the first burner 24 is fired in the low temperature mode, as indicated schematically in FIG. 3, the injector 32 at the first burner 24 receives fuel, but the injector 32 at the second burner 28 does not. A major portion of the combustion air stream emerging from the circular opening 41 at the first burner 24 flows into the long annular passage 53 between the first conduit 50 and the surrounding tube 10. A minor portion of the combustion air stream flows directly into the first conduit 50 along with the fuel stream. The mixture of those reactant streams begins to combust as it flows within the first conduit 50 in a direction downstream from the burner 24. A primary combustion zone 101 is thus formed within the first conduit 50. The products of combustion in the primary zone 101 emerge from the open end 58 within the hood 56. The hood 56 then directs those combustion products to flow through the short annular passage 65 and outward from the hood 56 to mix with the combustion air flowing through the long annular passage 53. A secondary combustion zone 102 then reaches downstream from the hood 56. As a result, primary and secondary combustion products mix and flow together around the turn 18, through the second leg 22 of the radiant tube 10, and outward through the second burner 28.

Figure 4:
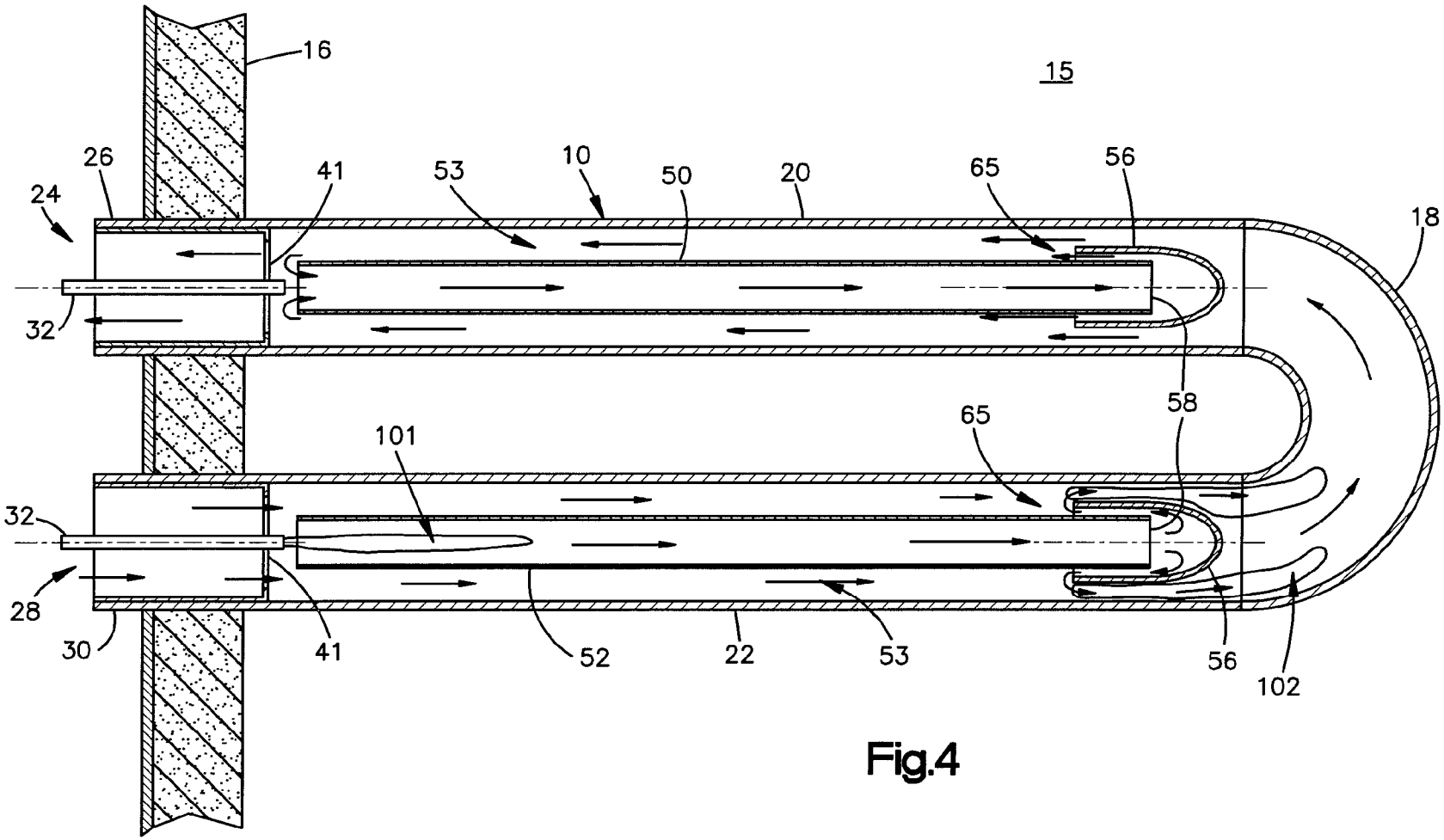
FIG. 4 is a schematic view similar to FIG. 1, schematically illustrating an operating condition that alternates with the condition of FIG. 3.

As further shown schematically in FIG. 3, the air and combustion products flowing over the hood 56 at the second conduit 52 aspirate the gaseous contents of that hood 56 into the long annular passage 53 extending over the second conduit 52. This drives a recirculating flow of air and combustion products between the opposite ends of the second conduit 52. In this manner the second conduit 50 provides recirculation that traverses substantially the entire length of the second leg 22 of the tube 10. Since the second leg 22 is located downstream of the turn 18, recirculation along that leg 22 helps to maximize the amount of combustion that occurs throughout the entire length of the tube 10 for given flow rates of fuel and combustion air that are provided to the firing burner 24 upstream of the turn 18. In the alternate condition shown in FIG. 4, the reverse process drives recirculation lengthwise of the first leg 20 between the opposite ends of the first conduit 50 when the regenerative cycle has shifted the second burner 28 from the exhaust condition to the firing condition.

Figure 5:
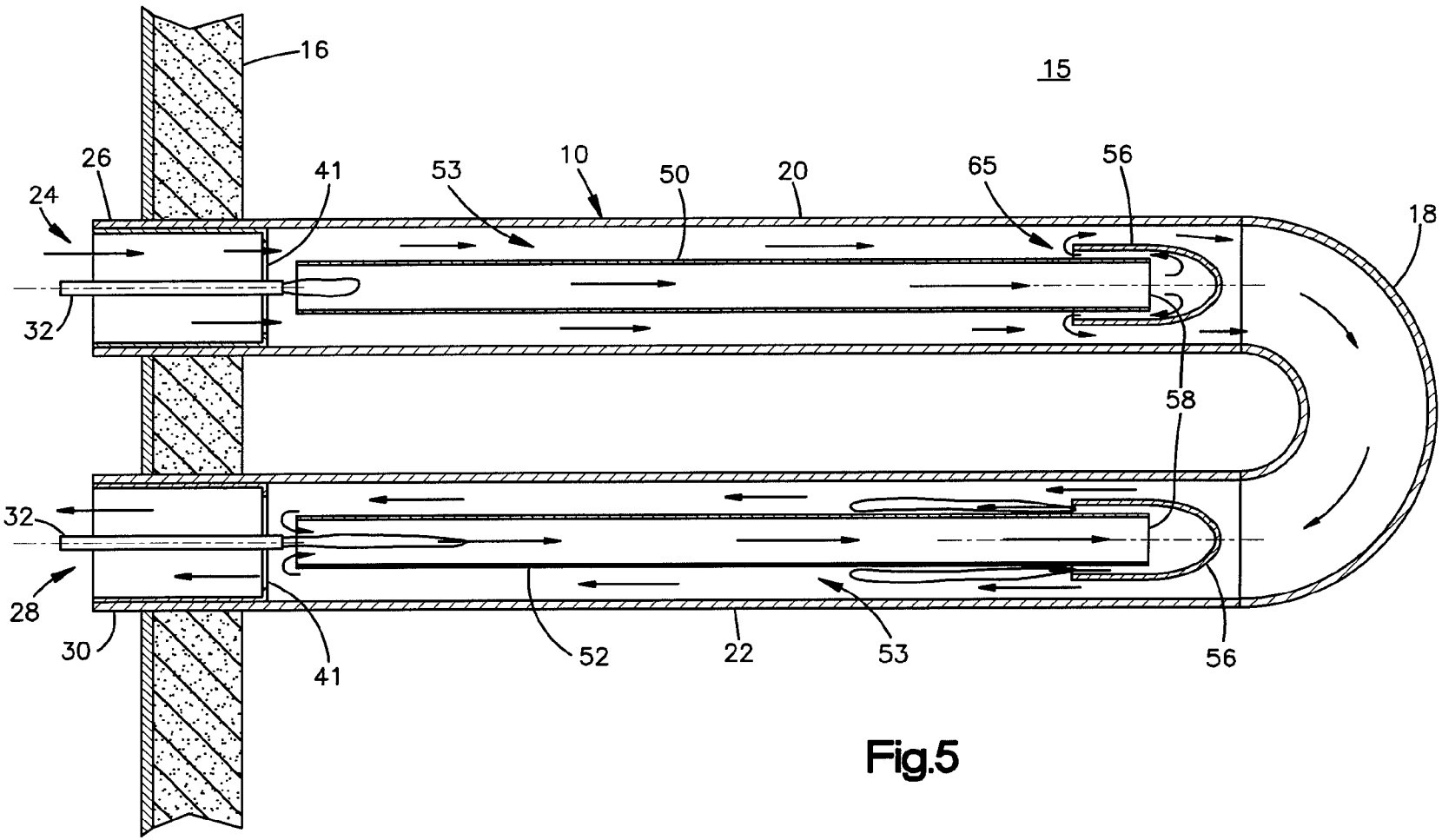
FIGS. 5 and 6 also are schematic views similar to FIG. 1 showing alternating operating conditions.

The high temperature mode is illustrated schematically in FIG. 5. When the first burner 24 is fired in the high temperature mode, it receives combustion air from the regenerative bed in the same manner as in the low temperature mode, and the products of combustion generated in the radiant tube 10 are exhausted through the second burner 28 in the same manner as in the low temperature mode. However, the fuel provided for combustion in the high temperature mode is not provided entirely at the first burner 24. Instead, a first stage of the fuel is provided at the injector 32 at the first burner 24 and a second stage of the fuel is provided at the injector 32 at the second burner 28.

Figure 6:
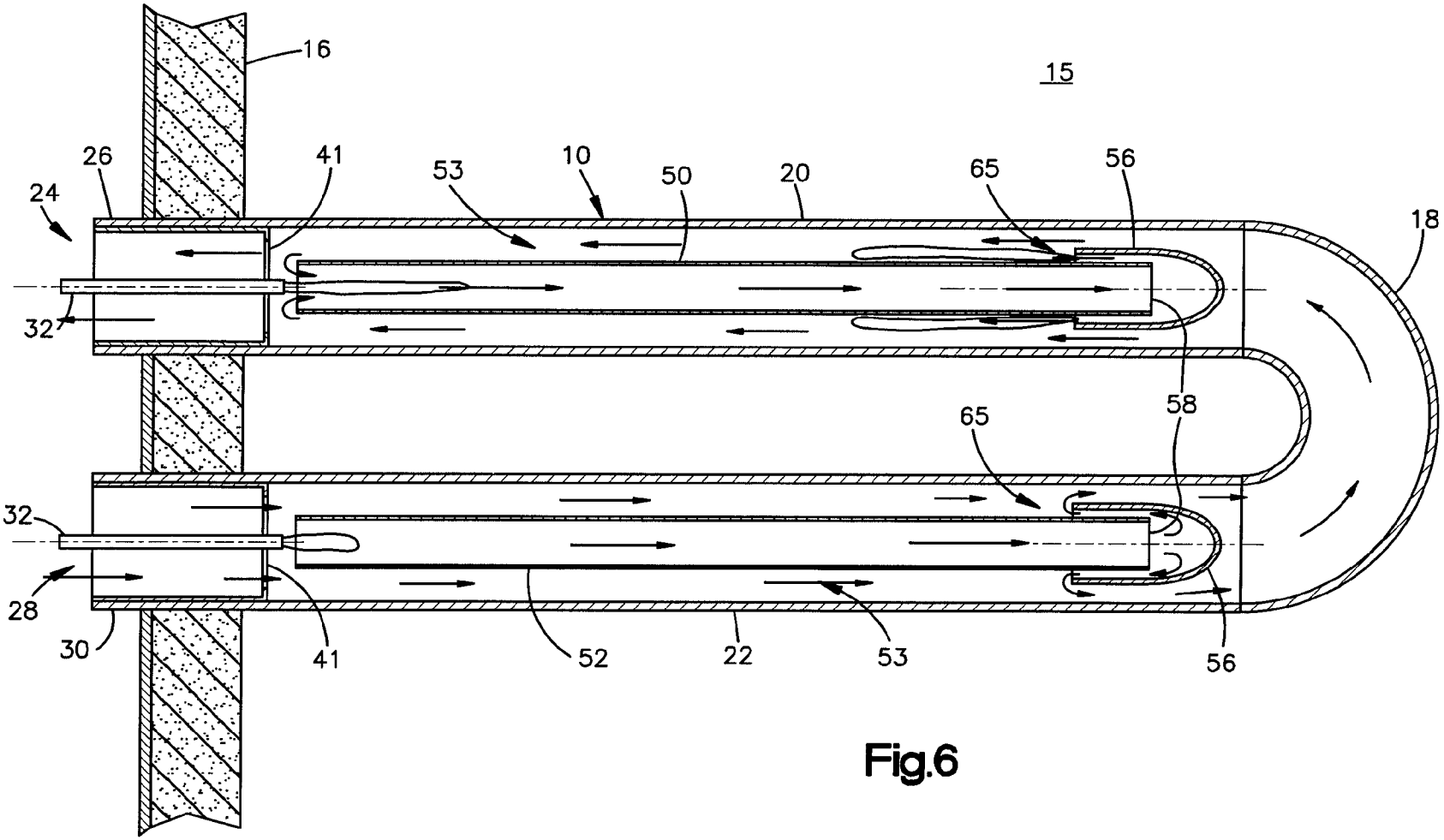

With the outlet 33 of the second fuel injector 32 spaced a short distance from the open end 54 of the second conduit 52, the stream of fuel emerging from that outlet 33 withdraws some of the combustion products from the downstream flow in the adjacent annular passage 53 by inspirating those combustion products into the second conduit 52. The fuel and inspirated combustion products form a mixture within the second conduit 52. Circulation and aspiration transport the mixture to the hood 56 and discharge it into the air and combustion products flowing downstream from the turn 18. Further combustion then proceeds along the annular passage 53 leading back toward the second burner 28. In the alternate condition of FIG. 6, recirculation through the first conduit 50 occurs in the same manner when the first burner 24 has been shifted to the exhaust condition and the second burner 28 has been shifted to the firing condition, with first stage fuel injected at the firing burner 28 and second stage fuel injected at the exhausting burner 24.

Figure 7:
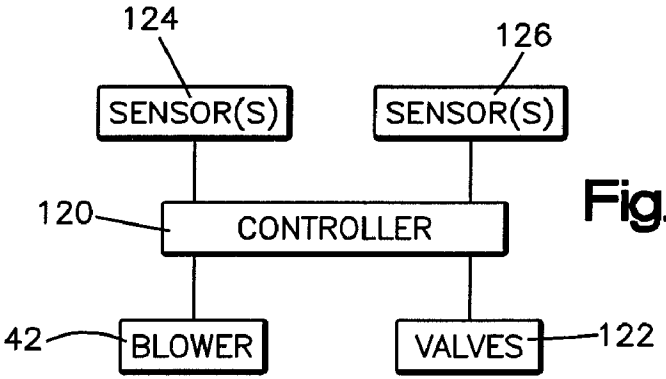
FIG. 7 is a schematic view of parts of the furnace apparatus of FIG. 1.

The proportions of first and second stage fuel injection can be varied with temperature and/or emission requirements. This can be accomplished by a controller 120 (FIG. 7) that operates valves 122 (FIG. 1) to control the flow rates of fuel and combustion air provided to the opposite ends 26 and 30 of the radiant tube 10. As the controller 120 shifts the valves 122 to alternate the burners 24 and 28 between regenerative firing and exhaust conditions, it monitors and responds to one or more temperature sensors 124 and one or more exhaust gas sensors 126 to vary the reactant streams accordingly. For example, FIGS. 5 and 6 each illustrate a proportion of second stage fuel that is greater than the proportion of first stage fuel. The proportion of second stage fuel is preferably increased to those levels as the contents of the tube 10 reach elevated temperatures that help to stabilize combustion at downstream locations remote from the firing burner. In any case, the proportion of second stage fuel is preferably high enough to provide a mixture that is sufficiently fuel rich to cause reburning of NOx in the downstream flow in which it circulates.

When either burner 24 or 28 is fired into the radiant tube 10 in the high temperature mode, the combustion air provided to the firing burner becomes consumed or diluted with inert products of combustion as it flows through the tube 10. As a result, the oxygen concentration in the gaseous contents of the tube 10 is progressively lower along the length of the tube 10 in the downstream direction from the firing burner toward the exhausting burner. By injecting staged fuel into the oxygen-depleted contents of the tube 10 at the exhausting burner, the injector 32 enables the combustion of second stage fuel to occur at minimal peak combustion temperatures. This can result in correspondingly minimal generation of NOx. Moreover, by transporting a dilute mixture of staged fuel and combustion products to an upstream location where the oxygen concentration is higher, which enables still further combustion to proceed downstream from that location, the recirculation conduits 50 and 52 multiply the residence time and distance through which combustion occurs along the length of the tube 10. This can maximize the transfer of heat from the tube 10 into the process chamber 15 in addition to minimizing the emission of NOx from the exhausting end of the tube 10.

Figure 8:
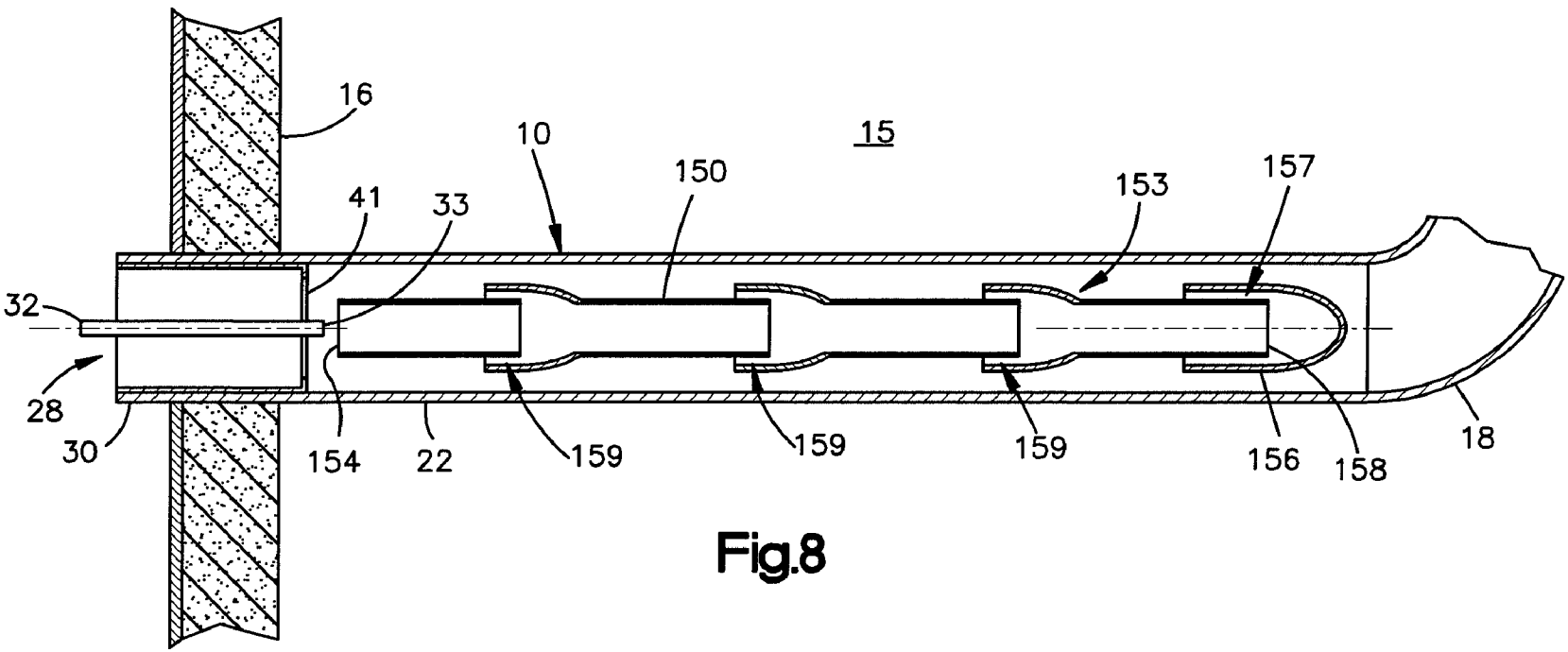
FIG. 8 is a schematic view of parts of the furnace apparatus of FIG. 1 in an alternative configuration.

FIG. 8 shows the radiant tube 10 equipped with a differently configured recirculation conduit 150. Like the conduits 50 and 52 described above, this conduit 150 is mounted within the tube 10 to define an elongated annular gas flow passage 153 radially between the conduit 150 and the tube 10. A first open end 154 of the conduit 150 is located a short distance downstream from the fuel outlet 33 at the adjacent burner 28. A hood 156 defines a short annular gas flow passage 157 from which the gaseous contents of the conduit 150 are aspirated from the second open end 158. However, unlike the conduits 50 and 52 described above, this conduit 150 is further configured with additional outlet passages 159 from which the gaseous contents of the conduit 150 are aspirated into the air and combustion products flowing downstream through the surrounding annular passage 153.

Figure 9:
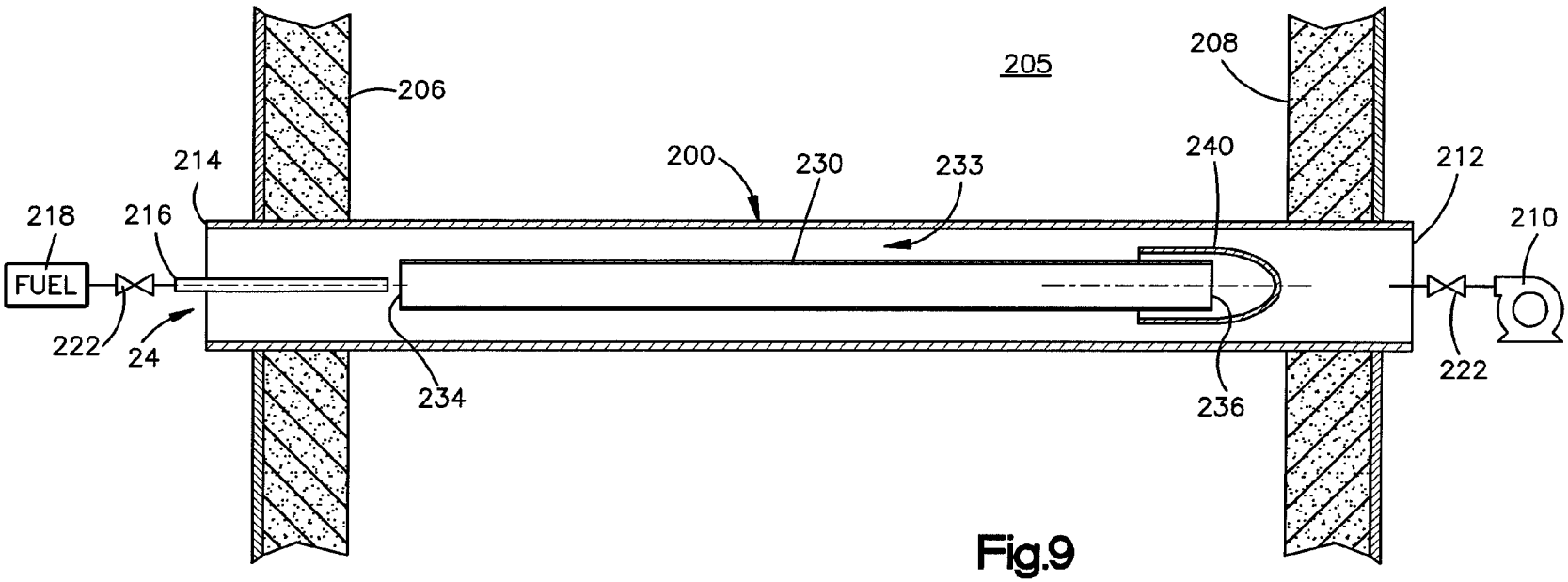
FIG. 9 is a schematic view of another furnace apparatus including a radiant tube equipped with a recirculation conduit.
Figure 10:
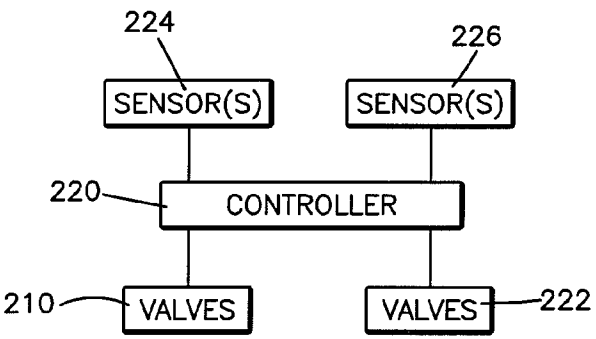
FIG. 10 is a schematic view of parts of the furnace apparatus of FIG. 9.

In the embodiment shown schematically in FIG. 9, a radiant tube 200 extends across a process chamber 205 in a straight line between a pair of furnace walls 206 and 208. A blower 210 provides the tube 200 with combustion air that flows through the tube 200 from an upstream end 212 to a downstream end 214. A fuel injector 216 is configured at the downstream end 214 of the tube 200 to inject a stream of fuel into the tube 200 in the upstream direction. As in the other embodiments, the fuel in this embodiment is preferably drawn from the plant supply of natural gas 218. Although this embodiment is not operated in regenerative cycles, a controller 220 (FIG. 10) operates valves 222 to control the flow rates of fuel and air in response to temperature and exhaust gas sensors 224 and 226 as needed to heat the process chamber 205.

A recirculation conduit 230 is mounted within the tube 200 to define an elongated annular gas flow passage 233 radially between the conduit 230 and the tube 200. An open downstream end 234 of the conduit 230 is located a short distance upstream from the fuel injector 216 for gaseous contents of the passage 233 to be inspirated into the tube 230 by a stream of fuel emerging from the injector 216. An open upstream end 236 of the conduit 230 is equipped with a hood 240 which, like the hoods 56 described above, is configured for gaseous contents of the conduit 230 to be aspirated into the passage 233 by the downstream flow of combustion air. Multiple discharge outlets, as shown for example in FIG. 8, could be provided here also. The resulting recirculation of fuel, combustion air, and combustion products along the length of the conduit 230 multiplies the residence time and distance through which combustion occurs along the length of the tube 200, and thereby maximizes the transfer of heat from the tube 200 into the process chamber 205 while minimizing the emission of NOx from the exhausting end 214 of the tube 200.

The patentable scope of the invention is defined by the claims, and may include other examples of how the invention can be made and used. Such other examples, which may be available either before or after the application filing date, are intended to be within the scope of the claims if they have elements that do not differ from the literal language of the claims, or if they have equivalent elements with insubstantial differences from the literal language of the claims.

What is claimed is:

1. An apparatus comprising:

a radiant tube;

a burner configured to fire into the radiant tube;

a recirculation conduit having an inlet within the radiant tube and an outlet within the radiant tube at location between the inlet and the burner;

an injector configured to inject staged fuel that inspirates gaseous contents of the radiant tube into the inlet of the recirculation conduit;

valves configured to control flows of fuel from a source to the burner and the injector; and a controller configured to operate the valves in a mode in which the valves provide fuel to the burner and the injector simultaneously.

2. An apparatus as defined in claim 1 wherein the outlet of the recirculation conduit is configured for adjacent gaseous contents of the radiant tube to aspirate the staged fuel from the outlet.

3. An apparatus as defined in claim 2 wherein the recirculation conduit has only a single outlet configured for adjacent gaseous contents of the radiant tube to aspirate the staged fuel from the outlet.

4. An apparatus as defined in claim 2 wherein the outlet is one of multiple outlets of the recirculation conduit, each of which is configured for adjacent gaseous contents of the radiant tube to aspirate the staged fuel from the outlet.

5. An apparatus as defined in claim 1 wherein the recirculation conduit has a length between the inlet and the outlet, and that length is located entirely within the radiant tube.

6. An apparatus as defined in claim 5 wherein the recirculation conduit is mounted within the radiant tube to define an elongated annular gas flow passage radially between the recirculation conduit and the radiant tube.

7. An apparatus as defined in claim 1 wherein the radiant tube has a turn between the burner and the outlet of the recirculation conduit.

8. An apparatus as defined in claim 1 wherein the burner, the recirculation conduit and the injector together comprise one of two oppositely oriented assemblies of a burner, a recirculation conduit and an injector that are configured relative to the radiant tube as recited in claim 1.

9. An apparatus comprising:

a radiant tube;

a burner configured to fire into the radiant tube in a direction downstream from the burner and thereby to generate a downstream flow of combustion products within the radiant tube;

an injector configured to inject staged fuel into the radiant tube in a direction upstream relative to the downstream flow of combustion products;

a recirculation conduit contained within the radiant tube, the recirculation conduit having an inlet aligned with the injector to receive the staged fuel along with combustion products inspirated into the recirculation conduit by the staged fuel, and having an outlet configured to discharge a mixture of the inspirated combustion products and staged fuel into the downstream flow of combustion products at a location between the inlet and the burner;

valves configured to control flows of fuel from a source to the burner and the injector; and a controller configured to operate the valves in a mode in which the valves provide fuel to the burner and the injector simultaneously.

10. An apparatus as defined in claim 9 wherein the outlet of the recirculation conduit is configured for the downstream flow of combustion products to aspirate the mixture from the outlet.

11. An apparatus as defined in claim 9 wherein the injector is part of a second burner configured to fire into the radiant tube oppositely relative to the burner of claim 9, and further comprising a second recirculation conduit with an inlet and an outlet arranged and configured within the radiant tube oppositely relative to the inlet and outlet of the recirculation conduit of claim 9.

12. An apparatus as defined in claim 11 wherein the radiant tube has a turn located between the recirculation conduits.

13. A method of combustion in a radiant tube having a turn between its opposite ends, comprising:

providing a downstream flow of combustion products in the radiant tube by directing air and first stage fuel into the radiant tube at a first location upstream of the turn;

injecting second stage fuel into the radiant tube at a second location downstream of the turn;

withdrawing combustion products from the downstream flow;

forming a mixture of the second stage fuel and withdrawn combustion products;

transporting the mixture upstream relative to the downstream flow along a recirculation flow path where the mixture does not mix with the downstream flow; and discharging the transported mixture from the recirculation flow path into the downstream flow at a third location between the first and second locations.

14. A method as defined in claim 13 wherein the second stage fuel is injected into the radiant tube in a manner that withdraws combustion products from the downstream flow by inspirating combustion products from the downstream flow into the recirculation flow path.

15. A method as defined in claim 13 wherein the third location where the transported mixture is discharged into the downstream flow also is downstream of the turn.

16. A method as defined in claim 13 wherein the transported mixture is discharged into the downstream flow at only a single location.

17. A method as defined in claim 13 wherein the transported mixture is discharged into the downstream flow at multiple locations.

18. A method as defined in claim 13 wherein the second stage fuel is injected into the radiant tube in a direction upstream relative to the downstream flow.

19. A method as defined in claim 13 wherein the downstream flow is generated by directing a pressurized flow of fuel and a pressurized flow of combustion air into the radiant tube through a first burner at one end portion of the radiant tube, and the second stage fuel is injected into the radiant tube by directing a pressurized flow of staged fuel without a pressurized flow of combustion air into the radiant tube through a second burner at an opposite end portion of the radiant tube.

20. A method as defined in claim 13 wherein the mixture is formed to be fuel rich sufficiently to cause reburning of NOx in the downstream flow.

* * * * *